US008545217B2

(12) United States Patent
Obuchi

(10) Patent No.: US 8,545,217 B2
(45) Date of Patent: Oct. 1, 2013

(54) LABEL MANUFACTURING METHOD AND LABEL MANUFACTURING APPARATUS

(75) Inventor: Tatsuya Obuchi, Chiba (JP)

(73) Assignee: Seiko Instruments Inc. (JP)

( * ) Notice: Subject to any disclaimer, the term of this patent is extended or adjusted under 35 U.S.C. 154(b) by 1191 days.

(21) Appl. No.: 12/386,845

(22) Filed: Apr. 23, 2009

(65) Prior Publication Data

US 2010/0304319 A1 Dec. 2, 2010

(30) Foreign Application Priority Data

Apr. 24, 2008 (JP) ..... 2008-113649

(51) Int. Cl.
*F27B 9/40* (2006.01)

(52) U.S. Cl.
USPC ..... 432/1; 432/5; 432/34; 432/121; 432/126; 156/320; 347/171; 347/16

(58) Field of Classification Search
USPC ..... 432/5, 34, 121, 126, 1; 156/320, 156/499, 64; 347/171, 220, 16, 187
See application file for complete search history.

(56) References Cited

U.S. PATENT DOCUMENTS

| | | | | |
|---|---|---|---|---|
| 5,123,758 | A * | 6/1992 | Uematsu | 400/63 |
| 6,497,468 | B1 * | 12/2002 | Otsuka | 347/16 |
| 2004/0257424 | A1 * | 12/2004 | Nureki | 347/187 |

FOREIGN PATENT DOCUMENTS

| | | |
|---|---|---|
| EP | 1352947 | 10/2003 |
| EP | 1356948 | 10/2003 |
| EP | 1602496 | 12/2005 |

* cited by examiner

*Primary Examiner* — Avinash Savani
(74) *Attorney, Agent, or Firm* — Adams & Wilks

(57) ABSTRACT

A label manufacturing apparatus has a thermal head with heating elements for heating at least a part of a heat sensitive adhesive sheet to place it into an adhesive state when the heat sensitive sheet is transported through a preselected position of the label manufacturing apparatus in which the heat sensitive sheet contacts the heating elements of the thermal head. A control device selectively operates the heating elements of the thermal head in synchronization with timing of transporting of the heat sensitive adhesive sheet through the preselected position to thereby heat the part of the heat sensitive adhesive sheet and place into the adhesive state, and stops operation of the heating elements so that a trailing end portion of the heat sensitive sheet is not heated and is not placed into an adhesive state when the trailing end portion reaches the preselected position.

11 Claims, 10 Drawing Sheets

LABEL MANUFACTURING METHOD AND LABEL MANUFACTURING APPARATUS

BACKGROUND OF THE INVENTION

1. Field of the Invention

The present invention relates to a label manufacturing method and a label manufacturing apparatus for manufacturing a label made of a heat sensitive adhesive sheet having a heat sensitive adhesive layer formed on a single side of a sheet-like substrate, which normally exhibits no adhesive properties but develops adhesive properties when being heated.

2. Description of the Related Art

Conventionally, a heat sensitive adhesive sheet having a heat sensitive adhesive layer that develops adhesive properties when being heated has been commercialized. Such a heat sensitive adhesive sheet as described above has advantages that the sheet before being heated can be handled easily because the sheet does not have the adhesive properties and that the heat sensitive adhesive sheet does not need release paper and industrial waste is thus not produced. Further, this label made of the heat sensitive adhesive sheet is attached onto various articles and is used in many fields such as a display like a bar code or the like for a point of sale (POS) of products such as foods, a shipping tag for distribution and delivery, a baggage tag in a hotel or a vehicle, or a display of contents of a bottle, a can, a cartridge or the like.

In general, the heat sensitive adhesive sheet is transported while heating means heats the heat sensitive adhesive layer to develop adhesive properties, whereby a desired label is manufactured. In order to heat the heat sensitive adhesive layer of the heat sensitive adhesive sheet, a thermal head that is commonly used as a recording head of a thermal printer is used as the heating means in many cases (see Patent Documents JP 2004-243606 A and JP 2004-136972 A). In this case, the heat sensitive adhesive layer of the heat sensitive adhesive sheet is pressed to the thermal head while the heat sensitive adhesive sheet is transported, whereby an entire surface of the heat sensitive adhesive layer or a part thereof is thermally activated to develop adhesion.

When the heat sensitive adhesive sheet is transported while the heating means is operated to heat the heat sensitive adhesive layer to be thermally activated as described above, a period of actuating the heating means is determined based on a desired label size. More specifically, operation of the heating means is stopped substantially at the same time when a trailing end portion of the heat sensitive adhesive sheet has passed through a position contacting with the heating means.

In a conventional label manufacturing method, as shown in FIG. 12, heating of a heat sensitive adhesive sheet 2 is performed until a trailing end portion 2*b* in a transporting direction of the heat sensitive adhesive sheet 2 passes through a position contacting with a heat-generating portion 4*a* of a thermal head 4 as described above, a problem may occur in some cases that a heat sensitive adhesive 2*e* at the trailing end portion 2*b* of the heat sensitive adhesive sheet 2 adheres to the thermal head 4 (see FIG. 12). Specifically, the heat sensitive adhesive 2*e* disposed on the heat sensitive adhesive sheet 2 is heated at a portion contacting with the heat-generating portion (heating element) 4*a* of the thermal head 4 and is thermally activated so as to develop adhesive properties. The heat sensitive adhesive 2*e* that is developing adhesive properties is in the state where the heat sensitive adhesive 2*e* can easily adhere to the thermal head 4. Usually, even if the heat sensitive adhesive 2*e* with the developed adhesive properties tends to adhere to the thermal head 4, the heat sensitive adhesive 2*e* is peeled away from the thermal head 4 as the heat sensitive adhesive sheet 2 is transported. Then, the heat sensitive adhesive 2*e* is only moved to the trailing end side of the heat sensitive adhesive sheet 2 a little by being dragged by the thermal head 4 in some degrees, and is carried away by the heat sensitive adhesive sheet 2. However, as illustrated in FIG. 12, at the trailing end portion 2*b* of the heat sensitive adhesive sheet 2, if the heat sensitive adhesive 2*e* with the developed adhesive properties is dragged by the thermal head 4 even in some degrees, the heat sensitive adhesive 2*e* is pushed off the heat sensitive adhesive sheet 2. Then, the pushed-off heat sensitive adhesive 2*e* does not sufficiently receive a force accompanying the transporting of the heat sensitive adhesive sheet 2, whereby the heat sensitive adhesive 2*e* may adhere to the thermal head 4 and remain thereon. If the manufacturing of the label is repeated, the heat sensitive adhesive 2*e* adhering to and remaining on the thermal head 4 as described above may be accumulated, which may be a factor of preventing smooth transporting of the heat sensitive adhesive sheet 2. Therefore, if many labels are manufactured, it is necessary to perform a maintenance work for cleaning the thermal head 4 so as to remove the heat sensitive adhesive 2*e* adhering to the same. This maintenance work prevents continuous manufacturing of many labels and decreases the efficiency.

SUMMARY OF THE INVENTION

Therefore, it is an object of the present invention to provide a label manufacturing method and a label manufacturing apparatus that are capable of suppressing adhesion and accumulation of the heat sensitive adhesive onto the thermal head from the trailing end portion in the transporting direction of the heat sensitive adhesive sheet so that a plurality of heat sensitive adhesive sheets can be transported smoothly and continuously.

According to the present invention, a label manufacturing method involving heating at least a part of a heat sensitive adhesive sheet to develop adhesive properties by using a thermal head having a plurality of heating elements and by using transporting means for transporting the heat sensitive adhesive sheet so as to pass the heat sensitive adhesive sheet through a position contacting with the heating elements of the thermal head, is characterized by including: driving the thermal head and the transporting means and selectively operating the plurality of heating elements of the thermal head in synchronization with timing of transporting of the heat sensitive adhesive sheet by the transporting means, to thereby heat the at least a part of the heat sensitive adhesive sheet to develop the adhesive properties; and if a trailing end portion in a transporting direction of the heat sensitive adhesive sheet reaches a position that is a predetermined distance before the position contacting with the heating elements of the thermal head, stopping heating by the thermal head and continuing to transport the heat sensitive adhesive sheet until at least the trailing end portion passes through the position contacting with the heating elements of the thermal head.

Further, according to the present invention, a label manufacturing apparatus is characterized by including: a thermal head having a plurality of heating elements; transporting means for transporting a heat sensitive adhesive sheet so as to pass the heat sensitive adhesive sheet through a position contacting with the heating elements of the thermal head; and a control device for driving the thermal head and the transporting means and selectively operating the plurality of heating elements of the thermal head in synchronization with timing of transporting of the heat sensitive adhesive sheet by the transporting means, to thereby heat at least a part of the heat sensitive adhesive sheet to develop adhesive properties, in which the control device drives the transporting means and the thermal head so that, if a trailing end portion in a transporting direction of the heat sensitive adhesive sheet reaches a position that is a predetermined distance before the position contacting with the heating elements of the thermal head, heating by the thermal head is stopped and the transporting of the heat sensitive adhesive sheet is continued until at least the trailing end portion passes through the position contacting with the heating elements of the thermal head.

The control device may drive the thermal head and the transporting means in accordance with a heating pattern like a matrix that is divided into dots having substantially the same size as a size of one of the heating elements.

The label manufacturing apparatus may further include a sheet detecting sensor disposed in a transporting path of the heat sensitive adhesive sheet by the transporting means on an upstream side of the thermal head in the transporting direction of the heat sensitive adhesive sheet, and the control means may determine a timing when the trailing end portion reaches the position that is the predetermined distance before the position contacting with the heating elements of the thermal head based on a distance between the sheet detecting sensor and the heating element of the thermal head when the sheet detecting sensor detects the trailing end portion of the heat sensitive adhesive sheet.

According to the present invention, by making the trailing end portion in the transporting direction of the heat sensitive adhesive sheet to be a non-heated part, it is suppressed that the heat sensitive adhesive is peeled away from the heat sensitive adhesive sheet and adheres to the thermal head to remain thereon. Thus, accumulation of the heat sensitive adhesive on the thermal head can be suppressed, whereby an obstacle to smooth transporting of the heat sensitive adhesive sheet can be prevented in advance.

DETAILED DESCRIPTION OF THE INVENTION

Hereinafter, embodiments of the present invention are described with reference to the drawings.

Figure 1:
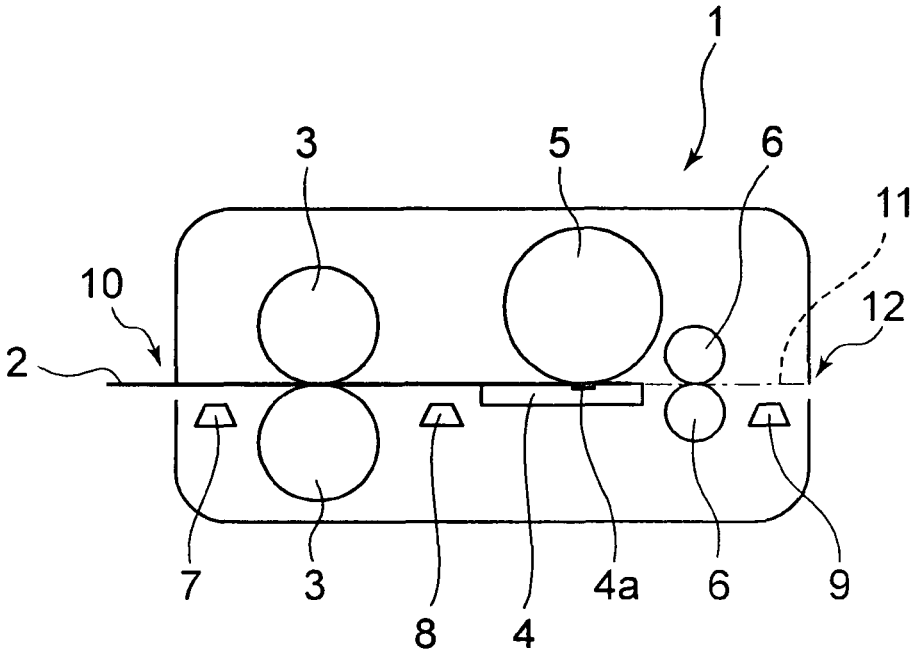
FIG. 1 is a schematic cross section illustrating an example of a label manufacturing apparatus that is used for a label manufacturing method of the present invention.

First, a basic structure of a label manufacturing apparatus 1 that is used in the present invention is described with reference to FIG. 1. This label manufacturing apparatus 1 includes a pair of insertion rollers 3 for leading a heat sensitive adhesive sheet 2 to an inside of the label manufacturing apparatus 1, a thermal head 4 for heating a heat sensitive adhesive layer of the heat sensitive adhesive sheet 2 so as to thermally activate the same, a platen roller 5 for sandwiching the heat sensitive adhesive sheet 2 between the same and the thermal head 4, a pair of discharge rollers 6 disposed on a downstream side of the thermal head 4, and sensors 7, 8, and 9. Those members are described one by one from an upstream side in a transporting direction.

A sheet insertion detecting sensor 7 is disposed at the vicinity of a lead inlet 10 of the label manufacturing apparatus 1. The sheet insertion detecting sensor 7 is disposed so that its sensor portion faces a transporting path 11 of the heat sensitive adhesive sheet 2, and detects presence or absence of the heat sensitive adhesive sheet 2 inserted from the lead inlet 10 to the vicinity of the insertion rollers 3.

The pair of insertion rollers 3 is disposed on the downstream side of the sheet insertion detecting sensor 7, and a contact between the rollers 3 is a part of the transporting path 11. One of the insertion rollers 3 may be a drive roller while the other may be a driven roller. A sheet detecting sensor 8 is disposed on the downstream side of the insertion rollers 3. The sheet detecting sensor 8 is disposed so that its sensor portion faces the transporting path 11, and detects a leading end portion 2*a* and a trailing end portion 2*b* (see FIG. 4B) of the heat sensitive adhesive sheet 2 transported from the insertion rollers 3 to the vicinity of the thermal head 4 and the platen roller 5.

The thermal head 4 and the platen roller 5 are disposed at the position to which the heat sensitive adhesive sheet 2 is led by the insertion rollers 3. The thermal head 4 may have a structure similar to that of a recording head that is used for a general thermal printer, and has a heat-generating portion 4*a* in which a plurality of heating elements, each of which is made of a small resistor, are arranged in a width direction (direction perpendicular to FIG. 1), for instance. The platen roller 5 is disposed to be opposed to the thermal head 4 so that the thermal head 4 and the platen roller 5 sandwich the heat sensitive adhesive sheet 2 on the transporting path 11. The platen roller 5 works as pressing means for pressing the heat sensitive adhesive sheet 2 to the heat-generating portion 4*a* of the thermal head 4 so as to perform good thermal activation, and rotates so as to transport the heat sensitive adhesive sheet 2.

The pair of discharge rollers 6 for discharging the heat sensitive adhesive sheet 2 from a discharging outlet 12 to the outside is disposed on the downstream side of the thermal head 4. Further, a sheet removal detecting sensor 9 is disposed at the vicinity of the discharge rollers 6. The sheet removal detecting sensor 9 is disposed so that its sensor portion faces the transporting path 11 of the heat sensitive adhesive sheet 2, and detects presence or absence of the heat sensitive adhesive sheet 2 before the heat sensitive adhesive sheet 2 is removed from the discharging outlet 12 to the outside.

Figure 2:
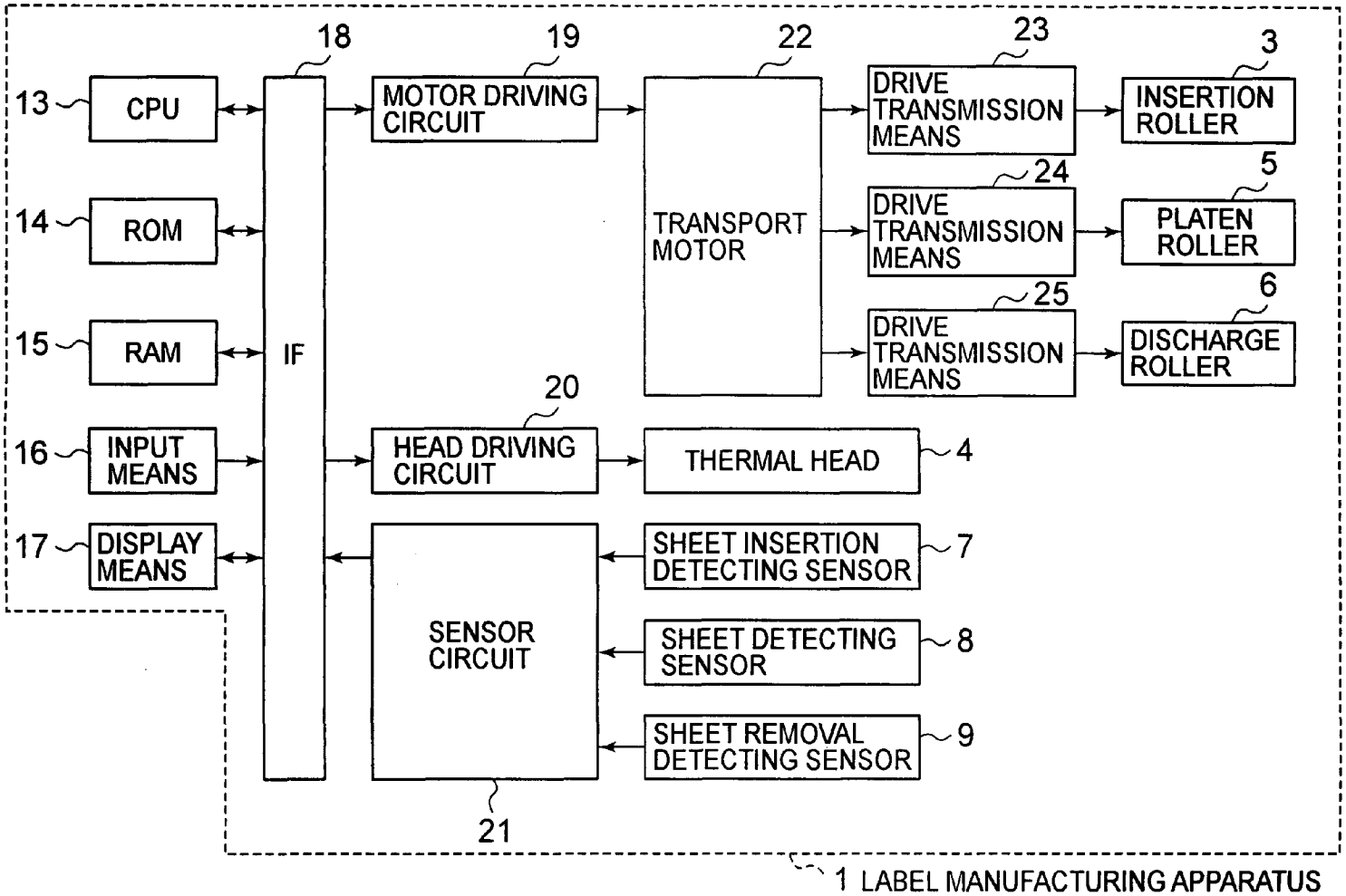
FIG. 2 is a block diagram illustrating an example of the label manufacturing apparatus of the present invention.

FIG. 2 illustrates a block diagram of this label manufacturing apparatus 1. A CPU (control means) 13 in the label manufacturing apparatus 1 refers to various data stored in a read only memory (ROM) 14 that is storage means while reading and writing data stored in a random access memory (RAM) 15 that is another storage means, so as to control the overall operation of the label manufacturing apparatus 1. The label manufacturing apparatus 1 further includes input means 16 and display means 17. It is possible to use a touch panel or the like made of a liquid crystal display panel or the like in which the input means 16 and the display means 17 are integrally provided. The CPU 13, the ROM 14, the RAM 15, the input means 16, and the display means 17 are connected to a motor driving circuit 19, a head driving circuit 20, and a sensor circuit 21 via an interface (IF) 18. Further, a transport motor 22 that is a stepping motor is connected to the motor driving circuit 19, the thermal head 4 is connected to the head driving circuit 20, and the three sensors 7, 8, and 9 are connected to the sensor circuit 21. As the transporting means, the insertion rollers 3, the platen roller 5, and the discharge rollers 6 are connected to the transport motor 22 of this embodiment via drive transmission means 23, 24, and 25, respectively. In this embodiment, all the structural elements are disposed in the label manufacturing apparatus 1 as illustrated in FIG. 2, and the single label manufacturing apparatus 1 constitutes a label manufacturing system. However, it is possible to adopt another structure in which the label manufacturing apparatus 1 is connected to a host computer (not shown) so as to constitute the label manufacturing system. In this case, it is possible to dispose the input means 16 and the display means 17 in the structure illustrated in FIG. 2 not in the label manufacturing apparatus 1 but in the host computer.

Basic steps of manufacturing a label by the label manufacturing system described above are described with reference to a flowchart illustrated in FIG. 3.

First, the sheet insertion detecting sensor 7 confirms that the heat sensitive adhesive sheet 2 is inserted from the lead inlet 10 (Step S1). Then, the CPU 13 activates the transport motor 22 via the IF 18 and the motor driving circuit 19, whereby the rollers (transporting means) 3, 5, and 6 are rotated via the drive transmission means 23 to 25. Thus, the heat sensitive adhesive sheet 2 is transported along the transporting path 11 by one row toward between the thermal head 4 and the platen roller 5 (Step S2).

When the sheet detecting sensor 8 detects the leading end portion 2*a* of the heat sensitive adhesive sheet 2 (see FIG. 4B) (Step S3), the CPU 13 drives the thermal head 4 via the IF 18 and the head driving circuit 20 at an appropriate timing. Thus, the heat-generating portion 4*a* of the thermal head 4 is heated. Though described more specifically later, the heating of the heat sensitive adhesive sheet 2 by heat generation of the heat-generating portion 4*a* of the thermal head 4 and the transporting of the heat sensitive adhesive sheet 2 by the insertion rollers 3, the platen roller 5, and the discharge rollers 6 one by one row are repeated alternately, whereby the thermal activation of the heat sensitive adhesive layer of the heat sensitive adhesive sheet 2 is performed (Step S4).

After that, the heat sensitive adhesive sheet 2 is discharged from the discharging outlet 12 to the outside one by one sheet by the rotation of the discharge rollers 6 (Step S5). Further, the heat sensitive adhesive sheets 2 that are cut in a desired label size are usually supplied to the label manufacturing apparatus 1, but the heat sensitive adhesive sheet 2 like a long continuous paper sheet may be supplied to the label manufacturing apparatus 1. In the latter case, the heat sensitive adhesive sheet 2 is cut into a desired label size appropriately by cutter means (not shown) disposed on the upstream side or the downstream side of the thermal head 4. The basic steps of the label manufacturing method of this embodiment are as described above.

In the label manufacturing method described above, this embodiment has a main feature in control of heating of the heat sensitive adhesive sheet 2 at the trailing end portion 2*b* in the transporting direction. First, a progress in which the inventor of the present invention has invented the heating method of this embodiment is described below.

As described above, if the heating of the heat sensitive adhesive sheet 2 is performed until the time point when the trailing end portion 2*b* in the transporting direction of the heat sensitive adhesive sheet 2 passes through the position contacting with the heat-generating portion 4*a* of the thermal head 4, a heat sensitive adhesive 2*e* on the heat sensitive adhesive sheet 2 may adhere to the thermal head 4. If the heat sensitive adhesive 2*e* adhering to the thermal head 4 is accumulated, the heat sensitive adhesive 2*e* may be an obstacle to transporting of the heat sensitive adhesive sheet 2 after that.

Figure 12:
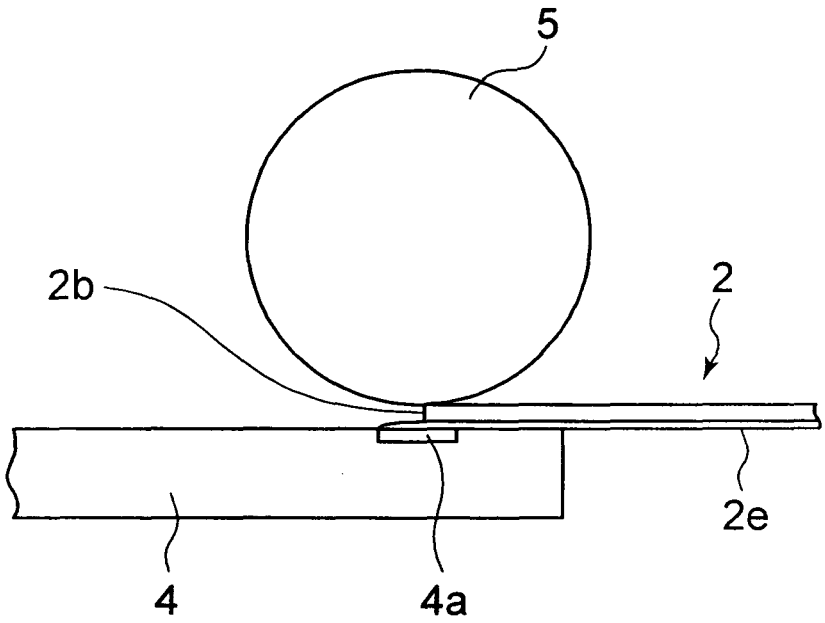
FIG. 12 is a schematic diagram illustrating a heating step of a trailing end portion of a heat sensitive adhesive sheet in a conventional label manufacturing method.

Therefore, the inventor of the present invention studied about the phenomenon that the heat sensitive adhesive 2*e* adheres to the thermal head 4 and remains on the thermal head 4, and has found that this phenomenon occurs at the trailing end portion 2*b* of the heat sensitive adhesive sheet 2 while the heat sensitive adhesive 2*e* at the leading end portion 2*a* or a middle portion of the heat sensitive adhesive sheet 2 hardly adheres to the thermal head 4 so as to remain thereon. In other words, even if the heat sensitive adhesive 2*e* at the leading end portion 2*a* or the middle portion of the heat sensitive adhesive sheet 2 develops its adhesive properties and tends to adhere to the thermal head 4, the heat sensitive adhesive 2*e* may only move a little to the trailing end side of the heat sensitive adhesive sheet 2 when being dragged by the thermal head 4, but finally the heat sensitive adhesive 2*e* is peeled away from the thermal head 4 and is carried away along with the movement of the heat sensitive adhesive sheet 2. In contrast, as illustrated in FIG. 12, if the heat sensitive adhesive 2*e* tends to adhere to the thermal head 4 at the trailing end portion 2*b* of the heat sensitive adhesive sheet 2, the heat sensitive adhesive 2*e* is promptly pushed off to the outside of the heat sensitive adhesive sheet 2. Therefore, a force trying to peel from the thermal head 4 accompanying the transporting of the heat sensitive adhesive sheet 2 does not exert so much. To sum up, even if the heat sensitive adhesive 2*e* developing adhesive properties is dragged by the thermal head 4 to move a little toward the trailing end side at the leading end portion 2*a* or the middle portion of the heat sensitive adhesive sheet 2, the heat sensitive adhesive 2*e* is still held by the heat sensitive adhesive sheet 2 and is peeled away from the thermal head 4 so as to be carried away along with the transporting of the heat sensitive adhesive sheet 2. On the other hand, if the heat sensitive adhesive 2*e* developing adhesive properties is dragged by the thermal head 4 to move a little toward the trailing end side at the trailing end portion 2*b* of the heat sensitive adhesive sheet 2, the heat sensitive adhesive 2*e* is promptly pushed off to the outside of the heat sensitive adhesive sheet 2 and is hardly held by the heat sensitive adhesive sheet 2. As a result, even if the heat sensitive adhesive sheet 2 is transported, the heat sensitive adhesive 2*e* pushed off to the outside of the heat sensitive adhesive sheet 2 remains to adhere to the thermal head 4.

Based on this consideration, the inventor of the present invention made the heat sensitive adhesive 2*e* at the trailing end portion 2*b* of the heat sensitive adhesive sheet 2 not to develop adhesive properties and made the heat sensitive adhesive 2*e* at the trailing end portion 2*b* to be in the same state as there is no adhesive agent. More specifically, as illustrated in FIG. 4B, the range close to the trailing end portion 2*b* of the heat sensitive adhesive sheet 2, specifically, the range from the trailing end portion 2*b* to the position at a predetermined distance (for example, 2 mm) before the trailing end portion 2*b* is made to be the non-adhesive portion (non-heated part R2'). For this purpose, in Step S4 illustrated in FIG. 3, the heating of the heat sensitive adhesive sheet 2 by heat generation of the heat-generating portion 4*a* of the thermal head 4 and the transporting of the heat sensitive adhesive sheet 2 one by one row by the insertion rollers 3, the platen roller 5 and the discharge rollers 6 are alternately repeated. If the heat sensitive adhesive layer of the heat sensitive adhesive sheet 2 is thermally activated, the operation of the thermal head 4 is completely stopped at the time point when the position at a predetermined distance (for example, 2 mm) before the trailing end portion 2*b* of the heat sensitive adhesive sheet 2 contacts with the heat-generating portion 4*a* of the thermal head 4. Then, the transporting means (rollers 3, 5 and 6) continues to transport the heat sensitive adhesive sheet 2, which is discharged from the discharging outlet 12. Thus, the label of this embodiment illustrated in FIG. 4B is completed. Note that some of scales of dimensions are not correct in some drawings (for example, FIGS. 4, 9 and the like) so that the drawings can be seen easily.

Figure 5:
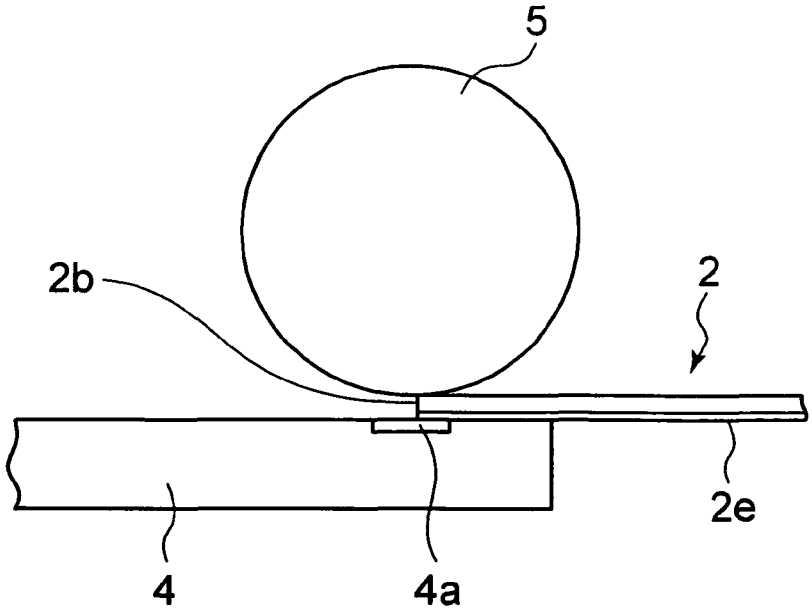
FIG. 5 is a schematic diagram illustrating a heating step of a trailing end portion of a heat sensitive adhesive sheet in the label manufacturing method according to the present invention.

As for the label of this embodiment formed in this way, a predetermined range (non-heated part R2') at the trailing end portion 2*b* of the heat sensitive adhesive sheet 2 is not heated and is not thermally activated. Therefore, the heat sensitive adhesive 2*e* at this part does not have adhesive properties and hardly has flowability, and hence the heat sensitive adhesive 2*e* has no tendency to adhere to the thermal head 4 as illustrated in FIG. 5, and is not dragged by the thermal head 4 to be pushed off to the outside of the heat sensitive adhesive sheet 2. Thus, the heat sensitive adhesive 2*e* does not adhere to the thermal head 4 to remain thereon, and there is no fear to disturb smooth transporting of the heat sensitive adhesive sheet 2 to be processed thereafter. Therefore, even if many labels are manufactured, it is not necessary to perform the maintenance work for cleaning the thermal head 4 so as to remove the heat sensitive adhesive 2*e*, and hence many labels can be manufactured continuously and efficiently.

Further, the non-heated part R2' is basically the non-adhesive portion, but the heat sensitive adhesive 2*e* that is heated and is thermally activated to develop adhesive properties and flowability is dragged by the thermal head 4 to move a little toward the trailing end side of the heat sensitive adhesive sheet 2 as described above. Therefore, it is considered that a part of the heat sensitive adhesive 2*e* that is heated and is thermally activated at the part further before the position at a predetermined distance (for example, 2 mm) before the trailing end portion 2*b* of the heat sensitive adhesive sheet 2 may move to the non-heated part R2'. Then, there may be a part having adhesive properties also in the non-heated part R2' because of the moved heat sensitive adhesive 2*e*, and hence the entire surface does not become the non-adhesive portion.

Example

A more concrete example of the label manufacturing method of the present invention is described.

Note that, in this example, the adhesive portion is formed in the heat sensitive adhesive sheet not in accordance with any one of the plurality of control data (plurality of heating patterns) stored in advance like the invention described in Patent Document 2, but the user can set the heating pattern freely. Specifically, in this example, the pattern of heating the heat sensitive adhesive sheet 2 by the thermal head 4 is regarded as one image region on the heat sensitive adhesive sheet 2 for generating image data, whereby the pattern can be processed similarly to a so-called bit map image.

Figure 6:
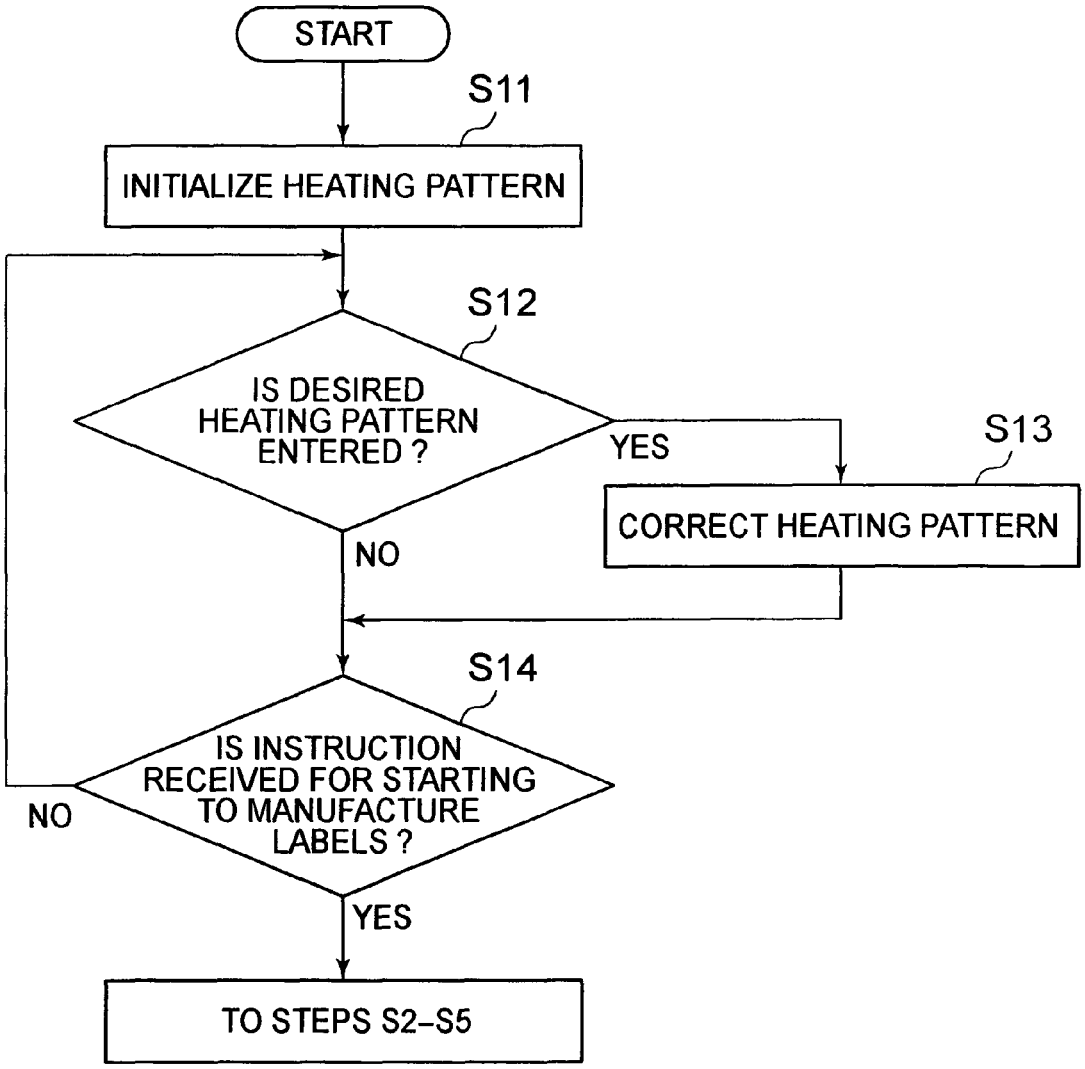
FIG. 6 is a flowchart illustrating steps performed before the basic steps illustrated in FIG. 3 of the label manufacturing method of the present invention.

In this example, as illustrated in FIG. 6, when the label manufacturing apparatus 1 starts to operate, initialization of the heating pattern is performed (Step S11). This means that data such as the heating pattern in the past manufacture of the label, which remains in the RAM 15, is erased so that the heating pattern (default heating pattern) of the initial data is once registered in the RAM 15. Note that the heating pattern of the initial data can be one for heating the entire surface. In this state, a new input of the heating pattern is waited. Then, when it is detected that the user has input the desired heating pattern by using the display means 17 and the input means 16 (Step S12), the heating pattern is corrected and is registered in the RAM 15 (Step S13).

Figure 7A:
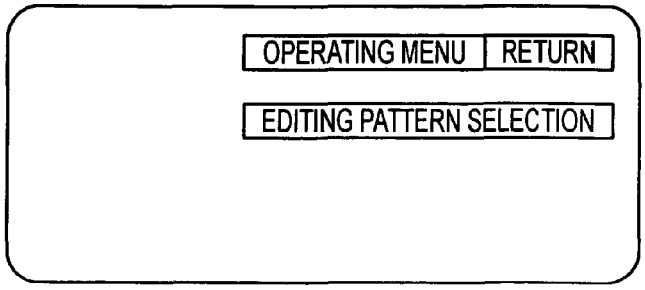
FIGS. 7A-7E are schematic diagrams illustrating screens for inputting the desired heating pattern of the label manufacturing method illustrated in FIG. 6.
Figure 7B:
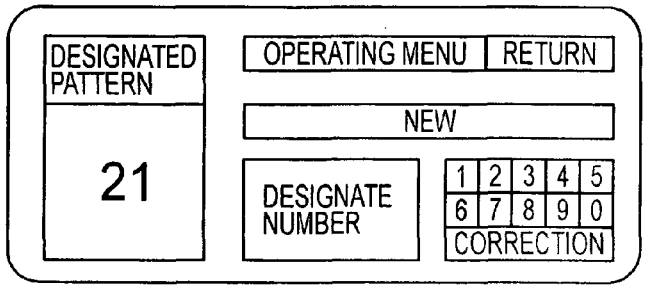
Figure 7C:
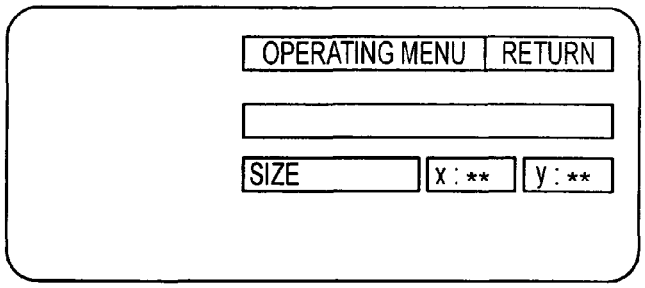
Figure 7D:
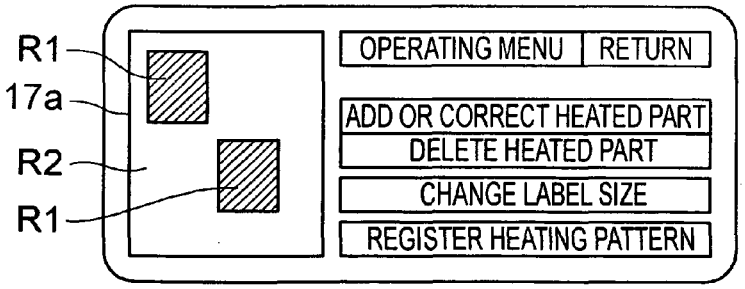
Figure 7E:
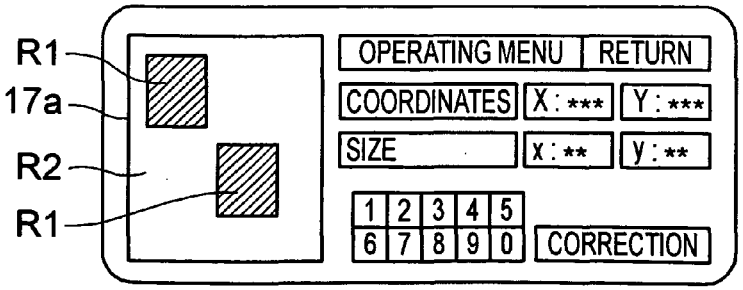
Figure 8:
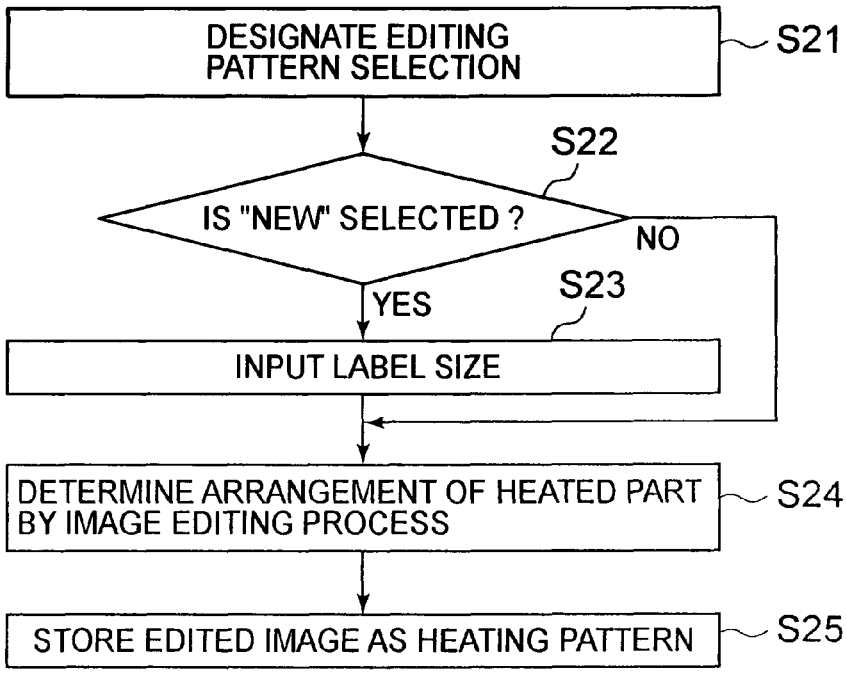
FIG. 8 is a flowchart illustrating detailed steps of inputting the desired heating pattern of an embodiment of the label manufacturing method illustrated in FIG. 6.

Here, a specific example of inputting the desired heating pattern by the user is described with reference to FIGS. 7 and 8. In this example, a liquid crystal touch panel is used, which works as the input means 16 as well as the display means 17. However, in the following description, the input means 16 and the display means 17 are described as separate components for convenience sake. This is to distinguish the individual functions of input and display different from each other.

First, editing pattern selection is designated by the input means 16 in the state where an initial menu screen (see FIG. 7A) is displayed on the display means 17 (Step S21). Then, a selection screen illustrated in FIG. 7B is displayed on the display means 17. On this stage, any one of generation of a new heating pattern and change of an existing heating pattern can be selected. In the former case, "new" is selected by the input means 16. In the latter case, the number of the heating pattern to be changed (heating pattern that is already stored) is entered by the input means 16 (Step S22). If the "new" is selected here, a size of the label to be manufactured is entered from the input means 16 on an input screen illustrated in FIG. 7C (Step S23). Based on this operation, a size and a shape of an image edit screen 17*a* are decided. Then, as illustrated in FIG. 7D, the image edit screen (binary image) 17*a* is displayed on the display means 17, "add or correct heated part", "delete heated part", "change label size", "register heating pattern" are shown as options of the next process. Therefore, "add or correct heated part" and "delete heated part" are selected appropriately, and the part displayed in black in the image edit screen 17*a* (heated part R1) is moved, deformed, expanded or contracted arbitrarily for deciding a desired location of the heated part R1 (Step S24). Further, the moving process, the deforming process, or the expansion or contraction process may be performed on the image edit screen 17*a* as described above, but it is possible to enter the coordinates or the size of the adhesive portion directly as illustrated in FIG. 7E for deciding the desired location of the heated part R1. The addition, the correction or the deletion of the heated part R1 can be set by a unit of one dot corresponding to the position and the size of the heating element. Then, if a size of the image edit screen 17*a*, i.e., the heat sensitive adhesive sheet 2 should be changed, "change label size" is selected on the screen illustrated in FIG. 7D. Then, the screen returns to the input screen illustrated in FIG. 7C, in which the size of the desired label should be entered again. In this way, the desired location of the heated part R1 is decided and then "register heating pattern" is selected so that the edited image is stored in the RAM 15 as the heating pattern (Step S25). Thus, input of the desired heating pattern is completed. Further, in this example, the desired heating pattern is image data shown as a binary image in matrix of M0×N0, which is divided into total N0 rows from the first row to the N0th row and the number of heating elements of the thermal head 4 (here, regarded as total M0) as illustrated in FIG. 4A.

Note that if the existing heating pattern should be changed, the number of the heating pattern to be changed is entered in Step S22. Then, input of the size of the label to be manufactured (Step S23) is omitted, and the image edit screen (binary image) 17*a* is displayed on the display means 17 as illustrated in FIG. 7D. Therefore, the desired location of the heated part R1 is decided similarly to the above-mentioned description (Step S24), and is registered as the desired heating pattern (Step S25). In this case, when the changed image is registered as the desired heating pattern, it is possible to adopt the structure in which to overwrite or to register as new data can be selected, although the structure is not illustrated.

Figure 4A:
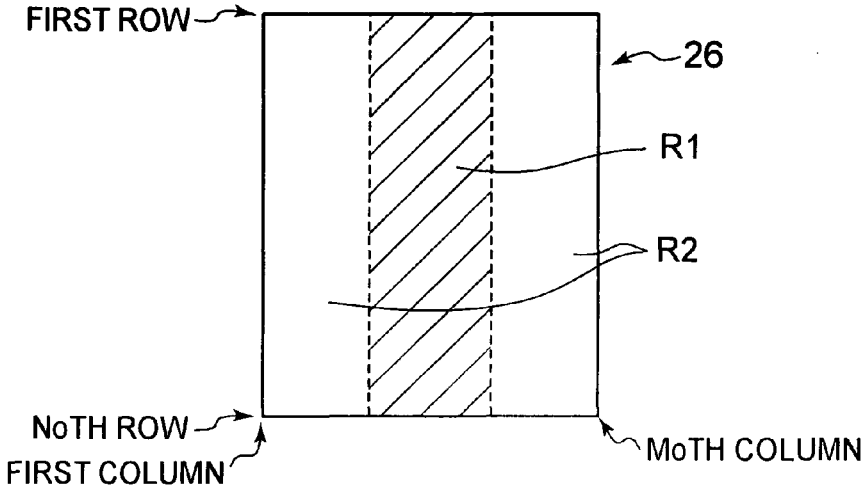
FIG. 4A is a schematic diagram illustrating an example of an image of a desired heating pattern.
Figure 9:
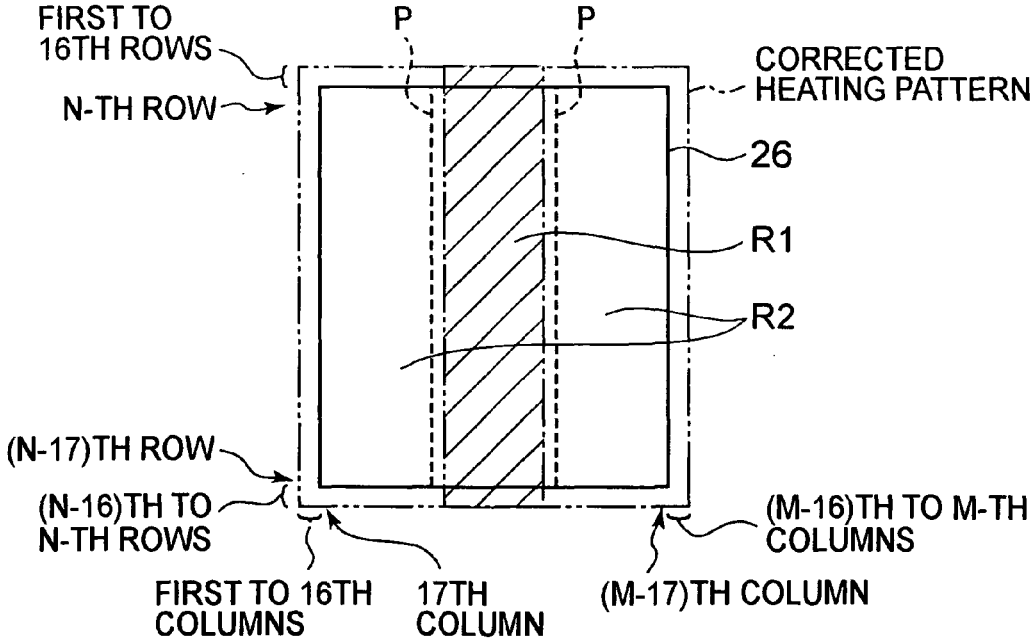
FIG. 9 is a schematic diagram illustrating a heating pattern after a correction in an example of the present invention.

The heating pattern input by the user in accordance with Steps S21 to S25 as described above is the desired heating pattern 26 on the basis of computation (theory) for manufacturing the desired label as illustrated in FIG. 4A, for instance. In this example, this input desired heating pattern is corrected (Step S13). The contents of the correction is to expand the heating pattern outward at each of rim portions by a few millimeters (e.g., 2 mm), and to change the position of an edge portion of the heated part R1 to be set back from a predetermined position by a few millimeters (e.g., 2 mm) at a boundary portion between the heated part (adhesive portion) R1 and the non-heated part (non-adhesive portion) R2. The heating pattern after the correction is image data in matrix of (N0 rows plus 4 mm)×(M0 columns plus 4 mm) in size as illustrated in FIG. 9. Further, one row and one column are set to be ⅛ mm each in this example, and hence it becomes (N0+32) rows×(M0+32) columns. If the sizes of the one row and one column are not ⅛ mm, the number of rows and the number of columns should be changed as a matter of course. This heating pattern after the correction is a matrix of N rows×M columns (here, N=N0+32, M=M0+32).

As described above, according to this example, the set heating pattern 26 is corrected for the heating of wide range so that the heated part R1 extends to the outside of the rim portion of the heat sensitive adhesive sheet 2. This is because that even if some error occurs at the heating position, the heating over the outside of the heat sensitive adhesive sheet 2 suppresses occurrence of the unintentional non-adhesive portion R2 in the rim portion of the label, and hence a fear of the label being easily removed can be reduced. In addition, when this correction is performed, it is controlled so that the edge portion of the adhesive portion (heated part) R1 is set back from a predetermined position in the boundary portion between the adhesive portion R1 and the non-adhesive portion R2. In other words, the boundary line between the adhesive portion R1 and the non-adhesive portion R2 is shifted a little (approximately a few millimeters) from the precise position determined corresponding to a shape and a size of the label to be manufactured toward the adhesive portion R1. Therefore, if a perforation P is provided, the boundary line between the adhesive portion R1 and the non-adhesive portion R2 is located at a position shifted from the perforation P toward the adhesive portion. Thus, even if a position error of the boundary line between the adhesive portion R1 and the non-adhesive portion R2 occurs due to a mechanical error in the operation of the label manufacturing apparatus (transport error of the heat sensitive adhesive sheet) or the like, a fear of forming the adhesive portion R1 beyond a predetermined position of the boundary line can be reduced to be significantly small. This is particularly effective in the case where the perforation P is formed in the heat sensitive adhesive sheet 2, and can reduce a fear of forming the adhesive portion over the perforation P, thereby a fear of tearing the label because of a difficulty of being separated along the perforation P can be reduced.

As described above, after the correction of the heating pattern 26 is performed, an instruction to start manufacturing the label actually is waited. This instruction may be a signal that is generated when the user operates a specific switch (not shown) of the label manufacturing apparatus 1 or may be a signal sent out from the sheet insertion detecting sensor 7 when the sheet insertion detecting sensor 7 detects the heat sensitive adhesive sheet 2 that is inserted by the user from the lead inlet 10 to the inside of the label manufacturing apparatus 1 (in this case, the step corresponds to Step S1 illustrated in FIG. 3). When such the instruction to start manufacturing of the label is received (Step S14), the label is manufactured in accordance with Steps S2 to S5 illustrated in FIG. 3. In Step S4, the heating is performed in accordance with the heating pattern after the correction that is corrected in Step S13 and the controlling method that is set in Step S13. This heating method performed in accordance with the heating pattern after the correction and the set controlling method is described in detail with reference to FIG. 10.

First, the transport motor 22 that is a stepping motor drives the rollers 3, 5, and 6 from the timing when the sheet detecting sensor 8 detects the leading end portion 2*a* of the heat sensitive adhesive sheet 2 in Step S3, and the number of rows until the leading end portion 2*a* of the heat sensitive adhesive sheet 2 reaches a computational position of a few millimeters (e.g., 2 mm) before the position contacting with the heat-generating portion 4*a* of the thermal head 4 is calculated in advance. This value can be calculated based on a distance between the sheet detecting sensor 8 and the heat-generating portion 4*a* of the thermal head 4 (e.g., 10 mm) and a transport distance of the heat sensitive adhesive sheet 2 per row (e.g., ⅛ mm). For instance, supposing that the distance between the sheet detecting sensor 8 and the heat-generating portion 4*a* of the thermal head 4 is 10 mm and the transport distance per row is ⅛ mm, the value is (10 mm−2 mm)/(⅛ mm)=64 rows.

Therefore, when the sheet detecting sensor 8 detects the leading end portion 2*a* of the heat sensitive adhesive sheet 2 in Step S3, the heat sensitive adhesive sheet 2 is transported from the detected position by the number of rows decided in advance (64 rows in the example described above) (Step S4*a*). The position at which the transporting is completed is the leading end position (first row) of the heating pattern after the correction (see FIG. 9). Therefore, a variable n indicating the row number in the heating pattern is set as n=1 (Step S4*b*). Further, if this position is shown in the heating pattern 26 before the correction (input desired heating pattern) illustrated in FIG. 4A, it is −2 mm, i.e., −16th row from the leading end position.

As described above, when the leading end portion 2*a* of the heat sensitive adhesive sheet 2 reaches the position of 2 mm before the computational position contacting with the heat-generating portion 4*a* of the thermal head 4, the thermal head 4 performs the heating in accordance with the data indicating the heating pattern of the heating pattern after the correction at the leading end position (first row) transmitted by the CPU 13 from the RAM 15 to the thermal head 4 (Step S4*c*). Then, the rollers 3, 5, and 6 transport the heat sensitive adhesive sheet 2 by one row (Step S4*d*). Then, if it is confirmed that the variable n indicating the row number does not match a row number N of the last row (Step S4*e*), the variable n is incremented by one to be set as n=n+1 (Step S4*f*). Then, it is confirmed that the sheet detecting sensor 8 has not detected the trailing end portion 2*b* of the heat sensitive adhesive sheet 2 (Step S4*g*).

After that, the heating (Step S4*c*), the transporting (Step S4*d*), the comparison between the variable n and the row number N of the last row (Step S4*e*), the increment of the variable n (Step S4*f*), and the confirmation that the sheet detecting sensor 8 has not detected the trailing end portion 2*b* of the heat sensitive adhesive sheet 2 (Step S4*g*) are repeated for each row of the heat sensitive adhesive sheet 2.

Further, data of each row in the heating pattern after the correction are transmitted appropriately by the CPU 13 from the RAM 15 to the thermal head 4, and the thermal head performs the heating in accordance with the transmitted data in Step S4*c*. In other words, the control for each of the heating elements to be heated or not in accordance with the transmitted data is performed. The data transmission is performed at an appropriate timing before the heating (Step S4*c*), for instance, during the transporting (Step S4*d*) or during the heating (Step S4*c*) of the preceding row.

Here, the heating patterns of the first row to the 16th row after the correction are all the same heating pattern, in which the heating pattern of the first row in the desired heating pattern 26 (heating pattern before correction) input in Step S12 is expanded to both sides in the width direction by 2 mm (16 columns) each. In this heating pattern, from the first column to the 16th column are all the same heating pattern as the 17th column (corresponding to first column of the heating pattern before correction), and from the (M-16)th column to the M-th column are all the same heating pattern as the (M-17)th column (corresponding to M0th column of heating pattern before correction). Therefore, in the same row, from the first column to the 17th column are all the same heating or non-heating column, and from the (M-17)th column to the M-th column are all the same heating or non-heating column. As described above, as a result of the expansion of the heating pattern in the width direction, from the first column to the 17th column are all the same heating or non-heating column, and from the (M-17) th column to the M-th column are all the same heating or non-heating column in the same row. The same is true for all the rows in the heating pattern after the correction.

From the 17th row to the (M-17)th row are rows in which the heating patterns from the first row to the last row (N0th row) in the heating pattern before the correction are expanded on both sides in the width direction by 2 mm (16 columns) each. In other words, the matrix of (17th row to (N-17) th row)×(17th column to (M-17) th column) in the heating pattern after the correction is completely the same as the matrix of (first row to N0th row)×(first column to M0th column) in the heating pattern 26 before the correction. Further, the first row to the 16th row, the (N-16)th row to the N-th row, the first column to the 16th column, and the (M-16)th column to the M-th column in the heating pattern after the correction are portions obtained by correcting the input heating pattern 26 to be expanded in four directions.

In this way, the thermal activation of each row of the heat sensitive adhesive sheet 2 is performed in Steps S4*c* to S4*g* sequentially. When the variable n indicating the row number reaches the row number N of the last row (Step S4*e*), it is confirmed that the sheet detecting sensor 8 has not detected the trailing end portion 2*b* of the heat sensitive adhesive sheet 2 (Step S4*g*) without performing the increment of the variable n (Step S4*f*). After that, with the variable n being fixed to N (in other words, it is confirmed that "n=N" holds in Step S4*e*, omitting Step S4*f*), the heating in accordance with the heating pattern of the N-th row (Step S4*c*), the transporting (Step S4*d*), and the confirmation that the sheet detecting sensor 8 has not detected the trailing end portion 2*b* of the heat sensitive adhesive sheet 2 (Step S4*g*) are repeated.

When the sheet detecting sensor 8 detects the trailing end portion 2*b* of the heat sensitive adhesive sheet 2 (Step S4*g*), the number of rows is counted from the time point of the detection until the portion of 2 mm before the trailing end portion 2*b* of the heat sensitive adhesive sheet 2 reaches the position contacting with the heat-generating portion 4*a* of the thermal head 4. Further, the number of rows from the time point when the sheet detecting sensor 8 detects the trailing end portion 2*b* of the heat sensitive adhesive sheet 2 in Step S4*g* to the timing when the portion of 2 mm before the trailing end portion 2*b* of the heat sensitive adhesive sheet 2 reaches the computational position facing the heat-generating portion 4*a* of the thermal head 4 after the transport motor 22 that is the stepping motor drives the rollers 3, 5, and 6, is determined in advance. This can be determined based on a distance between the sheet detecting sensor 8 and the heat-generating portion 4*a* of the thermal head 4 (e.g., 10 mm) and a transport length per row (e.g., ⅛ mm). For instance, if the distance between the sheet detecting sensor 8 and the heat-generating portion 4*a* of the thermal head 4 is 10 mm and the transport length per row is ⅛ mm, the distance becomes as (10 mm−2 mm)/(⅛ mm)=64 rows.

Therefore, the heating (Step S4*c*) and the transporting (Step S4*d*) are repeated for 64 rows from the time point when the sheet detecting sensor 8 detects the trailing end portion 2*b* of the heat sensitive adhesive sheet 2 in Step S4*g*. On this occasion, if it is already confirmed that "n=N" holds in Step S4*e* that was performed before, the heating based on the heating pattern of the N-th row is repeated without performing the increment of the variable n (Step S4*f*).

On the other hand, if it is not confirmed that "n=N" holds in Step S4*e* that was performed before while the sheet detecting sensor 8 detects the trailing end portion 2*b* of the heat sensitive adhesive sheet 2 in Step S4*g*, "n=N" does not hold yet at the time point when the heating (Step S4*c*) and the transporting are started to repeat for 64 rows as described above. In this case, every time when the heating (Step S4*c*) and the transporting (Step S4*d*) are performed, the increment of the variable n (Step S4*f*) is performed. Then, if it is confirmed that "n=N" holds (Step S4*e*), the heating based on the heating pattern of the N-th row is repeated from the time point of the confirmation without performing the increment of the variable n (Step S4*f*).

Figure 10:
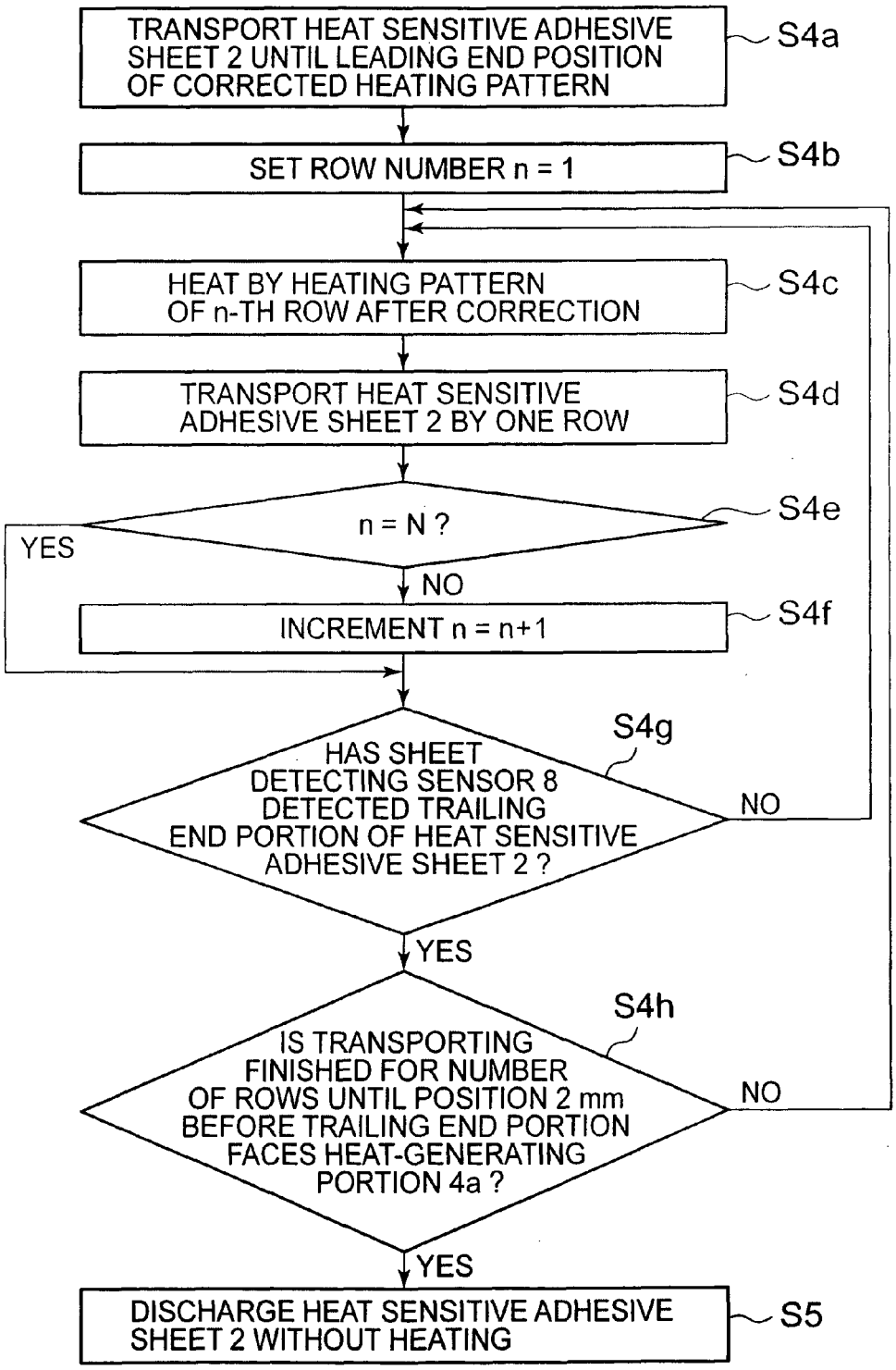
FIG. 10 is a flowchart illustrating detailed steps for thermal activation of the label manufacturing method illustrated in FIGS. 3 and 6.

Further, according to the flowchart illustrated in FIG. 10, the process passes each time through Step S4*g* in which it is confirmed whether or not the sheet detecting sensor 8 has detected the trailing end portion 2*b* of the heat sensitive adhesive sheet 2 while the heating (Step S4*c*) and the transporting are repeated for 64 rows as described above. However, it is already confirmed that the sheet detecting sensor 8 has detected the trailing end portion 2*b* of the heat sensitive adhesive sheet 2 (Step S4*g*), and hence it should be decided that the detection has been performed (Yes) when the process passes through Step S4*g* after that. Otherwise, no decision is performed in Step S4*g*. In any case, the counting is continued without resetting the number of rows that are already counted at the time point.

Figure 3:
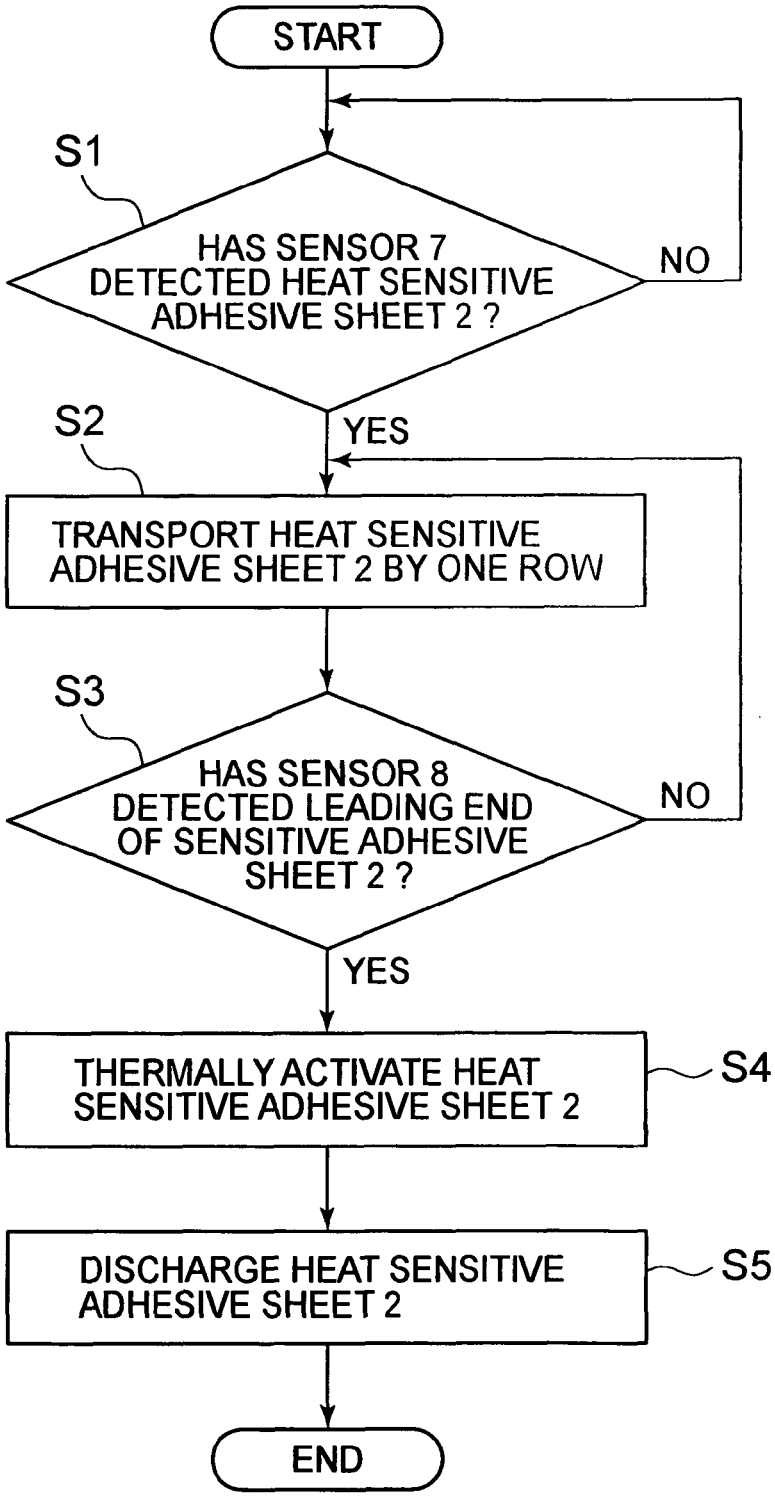
FIG. 3 is a flowchart illustrating basic steps of the label manufacturing method of the present invention.
Figure 4B:
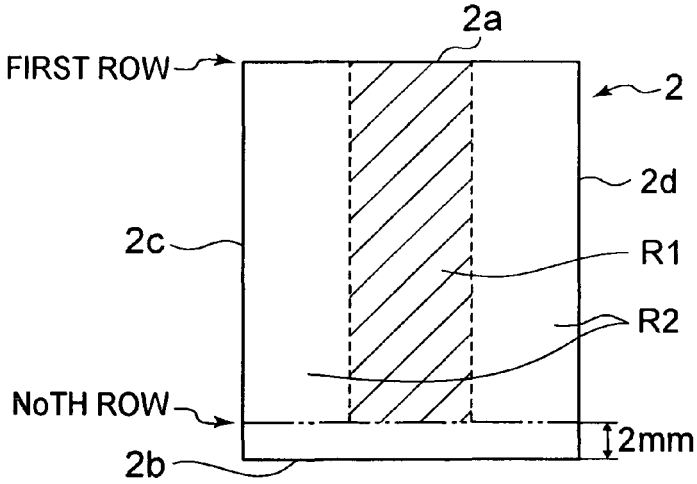
FIG. 4B is a schematic diagram illustrating a label manufactured by the present invention based on the heating pattern illustrated in FIG. 4A.

Further, in any one of the cases described above, when the heat sensitive adhesive sheet 2 is transported by 64 rows from the time point when the sheet detecting sensor 8 detects the trailing end portion 2*b* of the heat sensitive adhesive sheet 2 in Step S4*g* (Step S4*h*), the discharge roller 6 transports the heat sensitive adhesive sheet 2 so as to discharge the same from the discharging outlet 12 to the outside without performing the heating (corresponding to Step S5 of FIG. 3). This is the controlling method for stopping all the heating from the timing when the trailing end portion 2*b* of the heat sensitive adhesive sheet 2 reaches the position of a few millimeters (e.g., 2 mm) before the position facing the thermal head 4 as described above.

Further, in the flowchart illustrated in FIG. 10, there may be the case where the sheet detecting sensor 8 cannot detect the trailing end portion 2*b* of the heat sensitive adhesive sheet 2 even if it is confirmed that "n=N" holds in Step S4*e* and then the heating (Step S4*c*) based on the heating pattern of the N-th row, the transporting (Step S4*d*), and the confirmation that the sheet detecting sensor 8 has not detected the trailing end portion 2*b* of the heat sensitive adhesive sheet 2 (Step S4*g*) are repeated continuously. In such a case, the heating based on the heating pattern of the N-th row and the transporting of one row are repeated continuously in accordance with Step S4*c* and Step S4*d*. However, the heating pattern of the last row is repeated continuously until the timing when the portion of 2 mm before the trailing end portion 2*b* of the heat sensitive adhesive sheet 2 actually passes through the position facing the thermal head 4.

Further, although not referred to in the above-mentioned description with reference to FIG. 10, the edge portion of the adhesive portion R1, i.e., the heated part is set back by a predetermined distance (e.g., 2 mm) at the position corresponding to the boundary line between the adhesive portion R1 and the non-adhesive portion R2 of the heat sensitive adhesive sheet 2, from the heating pattern before the correction in this example. This is caused by the correction for setting back the edge portion of the heated part by a predetermined distance at the boundary between the heated part and the non-heated part of the heating pattern before the correction, which was performed together with the correction for expanding the heating pattern before the correction outward by a predetermined distance each in Step S13. In particular, if a perforation P is provided to at least a part of the position corresponding to the boundary line between the adhesive portion and the non-adhesive portion of the heat sensitive adhesive sheet 2, the heated part R1 is formed to be narrow so that the edge portion of the heated part R1 is located at the position shifted by approximately 2 mm to the heated part R1 side from the perforation P (boundary line of desired heating pattern 26 before the correction) (see FIG. 9). Those corrections are already performed on the heating pattern after the correction that was corrected in Step S13 and is used in Step S4*c*. Therefore, if the thermal head 4 works in accordance with the heating pattern after the correction, the heating control described above is performed automatically. The correction of the heating pattern is not performed every time the thermal head 4 performs the heating in Step S4*c*.

As described above in detail, according to this example, the heating is controlled so that the entire heating is stopped at the timing when the trailing end portion 2*b* in the transporting direction of the heat sensitive adhesive sheet 2 reaches the position a little before (for example, 2 mm before) the position facing the thermal head 4. Thus, it is prevented that the heat sensitive adhesive peeled away from the heat sensitive adhesive sheet 2 adheres to thermal head 4 and remains thereon. In addition, if the trailing end portion 2*b* of the heat sensitive adhesive sheet 2 moves slowly because of a certain reason and it is therefore necessary to heat the heat sensitive adhesive sheet 2 even after the last row (N-th row) of the desired heating pattern, the heating is controlled so as to repeat the heating pattern of the last row continuously. Thus, even if a relatively large error occurs, it is possible to prevent an unintentional non-adhesive portion from occurring at the rim portion of the label. In addition, it is avoided to provide the adhesive portion R1 more than necessary because that the entire row is not made the adhesive portion R1.

Further, as to this example, in Step S13, the correction is performed so that the rim portion of the desired heating pattern 26 is expanded outward, and the boundary line between the heated part R1 (adhesive portion) and the non-heated part R2 (non-adhesive portion) is moved toward the heated part R1 (edge portion of the heated part R1 is set back). Then, the heat sensitive adhesive sheet 2 is heated based on the pattern after the correction. By correcting the desired heating pattern 26 in this way, it is prevented that an unintentional non-adhesive portion generates at the rim portion of the label, whereby a fear of the label being easily removed can be reduced. In addition, it is possible to prevent the adhesive portion from being formed over a cutting off line, and hence the non-adhesive portion can be cut off easily and a fear of tearing the label can be reduced. This setting back of the edge portion of the heated part is effective particularly in the case where the perforation P is formed as the cutting off line. Note that as to the trailing end portion 2*b* in the transporting direction of the heat sensitive adhesive sheet 2, stopping of the heating as described above is performed, and hence the heating is not performed in the manner as the corrected heating pattern. Therefore, it is not always necessary to expand the rim portion of the desired heating pattern outward in all directions in Step S13. It is possible to expand the rim portion outward only in a particular direction (for example, in the directions except the trailing end portion 2*b*).

In the above-mentioned description, the correction of the heating pattern and the heating control are performed by the CPU 13 incorporated in the label manufacturing apparatus 1 itself. However, it is possible to connect a host computer (not shown) to this label manufacturing apparatus 1 so as to constitute the label manufacturing system. In this case, the CPU 13 incorporated in the label manufacturing apparatus 1 itself controls the heating and the transporting, while the setting and the correction of the heating pattern (Steps S11 to S13) are performed by the host computer. In other words, the host computer includes the CPU, the ROM, the RAM, the input means 16 such as a mouse or a keyboard, and the display means 17 such as a liquid crystal display or a cathode ray tube. The label manufacturing apparatus 1 includes the CPU (control means) 13, the ROM (storage means) 14, and the RAM (storage means) 15 for controlling the operations of the transport motor 22, the thermal head 4, and the sensors 7, 8, and 9, but those components do not have functions of setting and correcting the heating pattern. Further, the host computer performs the setting and the correction of the heating pattern, and the heating data after the correction is transmitted from the host computer to the label manufacturing apparatus 1. The CPU 13 of the label manufacturing apparatus 1 controls the operations of the transport motor 22, the thermal head 4, and the sensors 7, 8, and 9 in accordance with the transmitted heating pattern. Further, in this case, setting of the CPU 13, the ROM 14, and the RAM 15 of the host computer may be performed for the setting and the correction of the heating pattern as described above. Alternatively, application software that is installed in the host computer may include a program for performing the setting and the correction of the heating pattern, whereby the CPU 13 of the host computer can perform the setting and the correction of the heating pattern in the state where the software is installed.

As still another example of the structure, the setting and the correction of the heating pattern (Steps S11 to S13) are performed by the CPU 13 of the label manufacturing apparatus 1 itself, and only the input means 16 and the display means 17 are connected to the label manufacturing apparatus 1 as separate components.

Figure 11:
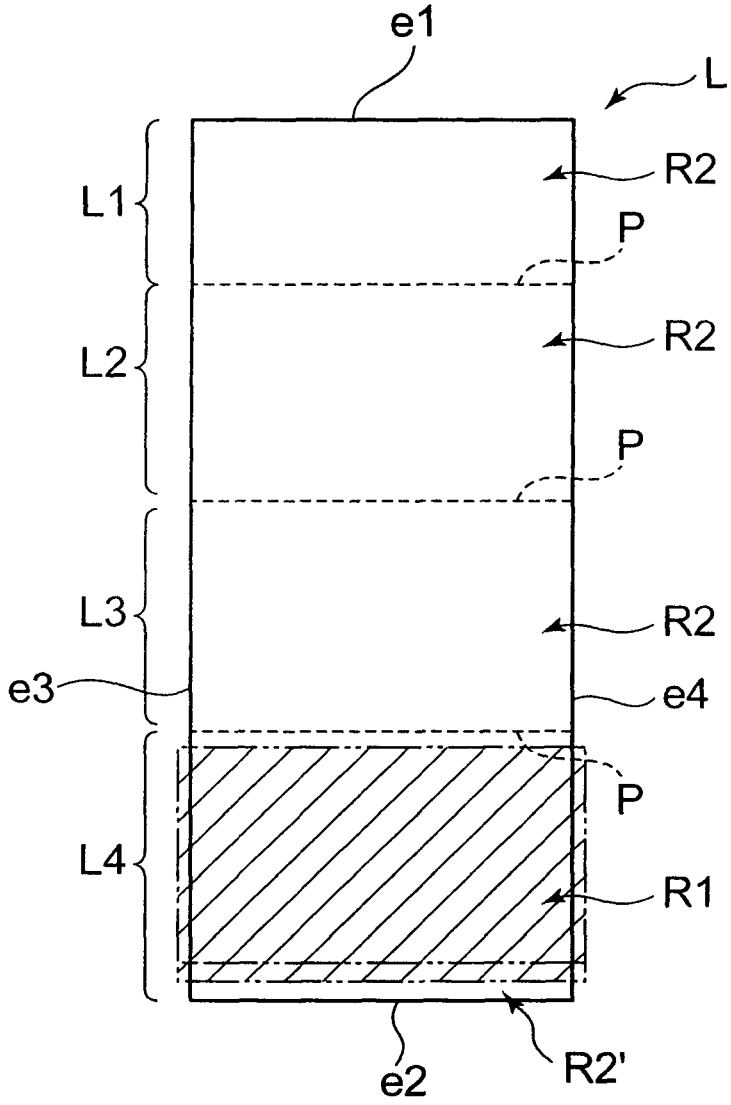
FIG. 11 is a schematic diagram illustrating an example of a label including an adhesive portion and a non-adhesive portion disposed in a mixed manner.

Lastly, an example of application of the label including the adhesive portion and the non-adhesive portion disposed in a mixed manner is described. A label L illustrated in FIG. 11 includes four portions L1 to L4. Only the fourth portion L4 is the adhesive portion (heated part R1 illustrated with hatching), and other portions L1, L2, and L3 are all the non-adhesive portions (non-heated part R2 illustrated without hatching). This label L is a slip for delivering a package, and the four portions L1 to L4 have substantially the same described contents, i.e., addresses, names, and telephone numbers of the sender and the receiver, and information necessary for the delivery (desired date and time of delivery, delivery fee, type of contents, and the like). The perforations P as tear-off lines are provided to the boundaries between the respective portions of the label L.

An example of a method of using the label L is described. First, a delivery company, which received a request for delivery from a sender who requests the delivery, manufactures the label illustrated in FIG. 11 in accordance with the manufacturing method described above. Then, the sender who requests the delivery or the delivery company fills in the portions L1 to L4 of the label L with necessary items, and the first portion L1 that is the non-adhesive portion is cut off and saved by the sender who requests the delivery as a copy for sender. On the other hand, the fourth portion L4 that is the adhesive portion is attached onto the package, and the delivery company carries the package holding the second to the fourth portions L2 to L4 thereon. The delivery company cuts off the second portion L2 that is the non-adhesive portion at an appropriate timing as necessary so as to save it as a copy for pickup and delivery. When the package holding the third portion L3 and the fourth portion L4 is carried and delivered to the receiver in this way, the receiver cuts off the third portion L3 that is the non-adhesive portion so as to save it as a copy for receiver. Finally, only the fourth portion L4 that is the adhesive portion remains held on the package.

In the foregoing label L, by adopting the manufacturing method described above, the heated part R1 (illustrated with hatching) extends to the outside of the label from end portions e3 and e4 in the width direction (left and right direction) in the fourth portion L4 and is the range from the perforations P to the inside of the fourth portion L4. Therefore, even if the heated part is shifted in the width direction (left and right direction) due to some mechanical error or the like, substantially the entire of the fourth portion L4 is thermally activated so as to develop adhesive properties. However, the vicinity of the perforation P even in the fourth portion L4 is not activated and is in the non-adhesive state. For this reason, even if some mechanical error or the like exists, it is not necessary to peel off the portion stuck to the package when the third portion L3 is cut off. Therefore, cutting of the label can be performed easily, and a risk of tearing the label at a part other than the perforation by mistake can be prevented. Further, the example of the label L illustrated in FIG. 11 has no adhesive portion in the leading end portion e1 of the label L. Therefore, the correction of expanding the heating pattern at the leading end portion e1 has no meaning in particular, and hence the correction can be omitted.

Further, also in this example, similarly to the embodiment described above, if the heating based on the last row of the heating pattern is finished before the trailing end portion 2*b* in the transporting direction of the heat sensitive adhesive sheet 2 reaches the position at a predetermined distance (for example, 2 mm) before the position contacting with the heat-generating portion 4*a* of the thermal head 4, the heating based on the last row of the heating pattern is repeated. When the trailing end portion 2*b* in the transporting direction of the heat sensitive adhesive sheet 2 reaches the position the predetermined distance (for example, 2 mm) before the position contacting with the heat-generating portion 4*a* of the thermal head 4, driving of the heat-generating portion 4*a* of the thermal head 4 is completely stopped while the transporting of the heat sensitive adhesive sheet 2 is continued. Thus, it is prevented that an unintentional non-adhesive portion is formed at the trailing end portion 2*b* of the heat sensitive adhesive sheet 2, and a fear of the label being easily removed is reduced. In addition, it is prevented that the heat sensitive adhesive 2*e* adheres to the thermal head 4 and remains thereon, and a fear of disturbing smooth transporting of the heat sensitive adhesive sheet 2 to be processed after that is reduced.

What is claimed is:

1. A label manufacturing apparatus, comprising:

a thermal head having a plurality of heating elements;

transporting means for transporting a heat sensitive adhesive sheet so as to pass the heat sensitive adhesive sheet through a position contacting with the heating elements of the thermal head; and a control device configured to control driving of the thermal head and the transporting means and to selectively operate the plurality of heating elements of the thermal head in synchronization with timing of transporting of the heat sensitive adhesive sheet by the transporting means, to thereby heat at least a part of the heat sensitive adhesive sheet to develop adhesive properties;

wherein the control device controls driving of the transporting means and the thermal head so that, when a trailing end portion of the heat sensitive sheet in a transporting direction of the heat sensitive adhesive sheet reaches a position that is a predetermined distance before the position contacting with the heating elements of the thermal head, heating by the thermal head is stopped so that the trailing end portion of the heat sensitive sheet is not heated and remains in a non-adhesive state, and the transporting of the heat sensitive adhesive sheet is continued until at least the trailing end portion in the non-heated state passes through the position contacting with the heating elements of the thermal head.

2. A label manufacturing apparatus according to claim 1, wherein the control device is configured to control driving of the thermal head and the transporting means in accordance with a heating pattern in the form of a matrix divided into dots having substantially the same size as a size of one of the heating elements.

3. A label manufacturing apparatus according to claim 1, further comprising a sheet detecting sensor disposed in a transporting path of the heat sensitive adhesive sheet transported by the transporting means on an upstream side of the thermal head in the transporting direction of the heat sensitive adhesive sheet;

wherein the control device is configured to determine a timing when the trailing end portion of the heat sensitive adhesive sheet reaches the position that is the predetermined distance before the position contacting with the heating elements of the thermal head based on a distance between the sheet detecting sensor and the heating element of the thermal head when the sheet detecting sensor detects the trailing end portion of the heat sensitive adhesive sheet.

4. A label manufacturing apparatus according to claim 2, further comprising a sheet detecting sensor disposed in a transporting path of the heat sensitive adhesive sheet transported by the transporting means on an upstream side of the thermal head in the transporting direction of the heat sensitive adhesive sheet;

wherein the control device is configured to determine a timing when the trailing end portion of the heat sensitive adhesive sheet reaches the position that is the predetermined distance before the position contacting with the heating elements of the thermal head based on a distance between the sheet detecting sensor and the heating element of the thermal head when the sheet detecting sensor detects the trailing end portion of the heat sensitive adhesive sheet.

5. A label manufacturing apparatus comprising:

a thermal head having a plurality of heating elements for heating at least a part of a heat sensitive adhesive sheet to place the part of the heat sensitive adhesive sheet into an adhesive state when the heat sensitive sheet is transported through a preselected position of the label manufacturing apparatus in which the heat sensitive sheet contacts the heating elements of the thermal head; and a control device configured for executing instructions contained in a processing program to selectively operate the plurality of heating elements of the thermal head in synchronization with timing of transporting of the heat sensitive adhesive sheet through the preselected position to thereby heat the part of the heat sensitive adhesive sheet and place into the adhesive state, and configured for executing instructions contained in the processing program to completely stop operation of the heating elements of the thermal head so that a trailing end portion of the heat sensitive sheet is not heated and is not placed into an adhesive state when the trailing end portion reaches the preselected position.

6. A label manufacturing apparatus according to claim 5, further comprising transporting means for transporting the heat sensitive adhesive sheet so as to pass the heat sensitive adhesive sheet through the preselected position; and wherein the control device is further configured for executing instructions contained in the processing program to transport the heat sensitive sheet at least until the trailing end portion in the non-adhesive state is passed through the preselected position.

7. A label manufacturing apparatus according to claim 5, wherein the control device is further configured for executing instructions contained in the processing program to control driving of the thermal head in accordance with a heating pattern in the form of a matrix divided into dots having substantially the same size as a size of one of the heating elements.

8. A label manufacturing apparatus according to claim 7, further comprising a sheet detecting sensor disposed in a transporting path of the heat sensitive adhesive sheet on an upstream side of the thermal head; wherein the control device is further configured for executing instructions contained in the processing program to determine a timing when the trailing end portion of the heat sensitive adhesive sheet reaches a position at a preselected distance from the preselected position based on a distance between the sheet detecting sensor and the heating element of the thermal head when the sheet detecting sensor detects the trailing end portion of the heat sensitive adhesive sheet.

9. A label manufacturing apparatus according to claim 5, further comprising a sheet detecting sensor disposed in a transporting path of the heat sensitive adhesive sheet on an upstream side of the thermal head; wherein the control device is further configured for executing instructions contained in the processing program to determine a timing when the trailing end portion of the heat sensitive adhesive sheet reaches a position at a preselected distance from the preselected position based on a distance between the sheet detecting sensor and the heating element of the thermal head when the sheet detecting sensor detects the trailing end portion of the heat sensitive adhesive sheet.

10. A label manufacturing apparatus, comprising:

a thermal head having a plurality of heating elements;

transporting means for transporting a heat sensitive adhesive sheet so as to pass the heat sensitive adhesive sheet through a position contacting with the heating elements of the thermal head; and a control device configured to control driving of the thermal head and the transporting means and to selectively operate the plurality of heating elements of the thermal head in synchronization with timing of transporting of the heat sensitive adhesive sheet by the transporting means, to thereby heat at least a part of the heat sensitive adhesive sheet to develop adhesive properties;

wherein the control device controls driving of the transporting means and the thermal head so that, when a trailing end portion of the heat sensitive sheet in a transporting direction of the heat sensitive adhesive sheet reaches a position that is a predetermined distance before the position contacting with the heating elements of the thermal head, heating by the thermal head is stopped and the transporting of the heat sensitive adhesive sheet is continued until at least the trailing end portion passes through the position contacting with the heating elements of the thermal head; and wherein the control device is configured to control driving of the thermal head and the transporting means in accordance with a heating pattern in the form of a matrix divided into dots having substantially the same size as a size of one of the heating elements.

11. A label manufacturing apparatus according to claim 10, further comprising a sheet detecting sensor disposed in a transporting path of the heat sensitive adhesive sheet transported by the transporting means on an upstream side of the thermal head in the transporting direction of the heat sensitive adhesive sheet;

wherein the control device is configured to determine a timing when the trailing end portion of the heat sensitive adhesive sheet reaches the position that is the predetermined distance before the position contacting with the heating elements of the thermal head based on a distance between the sheet detecting sensor and the heating element of the thermal head when the sheet detecting sensor detects the trailing end portion of the heat sensitive adhesive sheet.

* * * * *